US006441570B1

(12) United States Patent
Grubba et al.

(10) Patent No.: US 6,441,570 B1
(45) Date of Patent: Aug. 27, 2002

(54) CONTROLLER FOR A MODEL TOY TRAIN SET

(75) Inventors: Robert A. Grubba, Rochester Hills, MI (US); Neil Young, Redwood City, CA (US); Charles P. Horan, East Pointe; Martin D. Pierson, Howell, both of MI (US)

(73) Assignee: Lionel, LLC., Chesterfield, MI (US)

( * ) Notice: Subject to any disclaimer, the term of this patent is extended or adjusted under 35 U.S.C. 154(b) by 0 days.

(21) Appl. No.: 09/332,649

(22) Filed: Jun. 14, 1999

(51) Int. Cl.[7] ..... H02K 7/14

(52) U.S. Cl. ..... 318/3; 318/9; 105/1.5; 104/DIG. 1; 213/75 TC; 246/122 A; 246/192 R; 446/467; 701/19

(58) Field of Search ..... 105/1.5; 104/DIG. 1; 213/75 TC; 246/122 A, 121, 167 R, 182 R, 187 A, 193, 192 A, 187 R; 446/431, 443, 465, 467; 701/1, 19, 20, 22; 318/3, 9–11

(56) References Cited

U.S. PATENT DOCUMENTS 5,174,216 A * 12/1992 Miller et al. ..... 104/296
5,251,856 A * 10/1993 Young et al. ..... 246/4
5,896,017 A * 4/1999 Severson et al. ..... 318/280
6,065,406 A * 5/2000 Katzer et al. ..... 105/1.5

* cited by examiner

*Primary Examiner*—Robert E. Nappi
*Assistant Examiner*—Rina I. Duda
(74) *Attorney, Agent, or Firm*—Young & Basile, P.C.

(57) ABSTRACT

The present invention provides a controller for a model toy train set. In a first aspect of the invention, the controller includes a plurality of input connectors for receiving supply power from one or more remote power supplies and providing such power to a plurality of output connectors. In a second aspect of the invention, the controller includes an input device for producing an input signal to limit the amount of output power supplied from the controller to a toy train set when the controller is remotely operated from a remote transmitter. In a third aspect of the invention, the controller includes a programming circuit having a first mode for controlling a plurality of output channels from separate sets of inputs and a second mode for controlling the plurality of output channels from a single set of inputs.

29 Claims, 9 Drawing Sheets

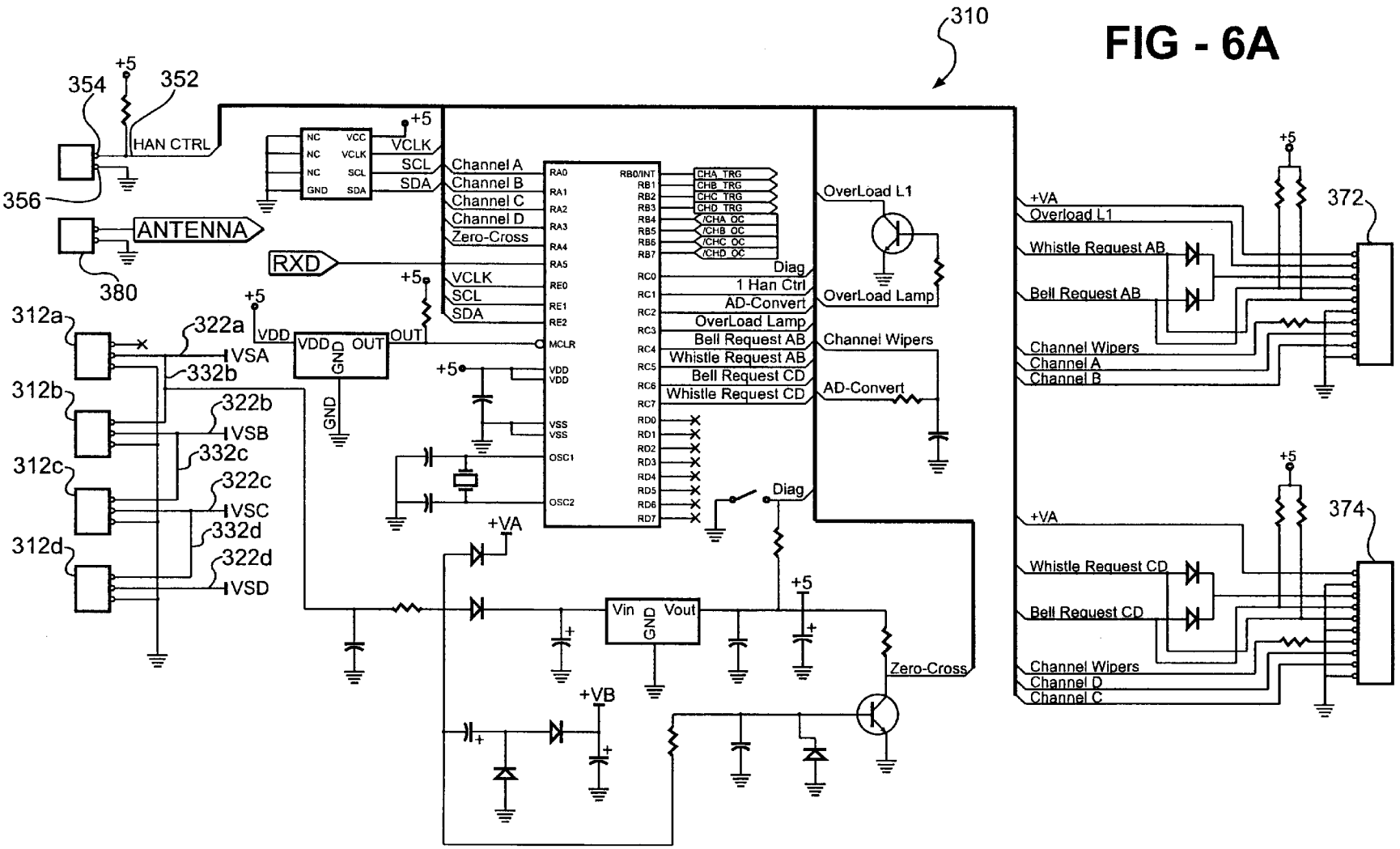
FIG - 6A
310
372
374
+5
+VA
Overload L1
Whistle Request AB
Bell Request AB
Channel Wipers
Channel A
Channel B
Whistle Request CD
Bell Request CD
Channel D
Channel C
OverLoad L1
OverLoad Lamp
AD-Convert
Zero-Cross
Diag
1 Han Ctrl
CHA_TRG
CHB_TRG
CHC_TRG
CHD_TRG
/CHA_OC
/CHB_OC
/CHC_OC
/CHD_OC
RB0/INT
RA0
RA1
RA2
RA3
RA4
RA5
RE0
RE1
RE2
MCLR
VDD
VSS
OSC1
OSC2
RC0
RC1
RC2
RC3
RC4
RC5
RC6
RC7
RD0
RD1
RD2
RD3
RD4
RD5
RD6
RD7
VCLK
SCL
SDA
OUT
GND
Vin
Vout
+VB
RXD
ANTENNA
HAN CTRL
VSA
VSB
VSC
VSD
322a
322b
332b
332c
322c
332d
322d
312a
312b
312c
312d
352
354
356
380

CONTROLLER FOR A MODEL TOY TRAIN SET

FIELD OF THE INVENTION

The present invention relates to a controller for a model toy train set.

BACKGROUND OF THE INVENTION

Most modern model toy train sets include one or more trains which travel around one or more train track loops. Each model toy train has at least one electrically controlled locomotive for moving the train around a train track loop. Each train set also includes some type of control system for controlling the movement of the electric locomotive.

Conventional toy train controllers include a plurality of outputs for providing power to control the speed and direction of the one or more electric locomotives. In addition, conventional controllers are also designed to operate other train accessories, such as a train horn and/or a train bell, associated with each output. Although they provide many control features, prior art controllers have several shortcomings.

A first shortcoming relates to input or supply power. Prior art controllers are designed to receive supply power from only one power supply. Such a design significantly limits the amount of power which can be delivered to each of the plurality of outputs. Accordingly, it would be desirable to provide a controller capable of receiving power from one or more power supplies and providing such power to a plurality of outputs.

A second shortcoming relates to the remote control of prior art controllers. Many prior art controllers are designed to be remotely controlled from a portable, hand held transmitter. Unfortunately, many young or novice operators experience difficulty in keeping an electric toy train under control when operating the train set from a transmitter. Accordingly, it would also be desirable to provide a controller capable of limiting the amount of output power supplied to a toy train set when the controller is remotely operated from a transmitter.

A third shortcoming relates to operator inputs. Many prior art controllers include a plurality of output channels, with each output channel controlled by a separate set of input switches. Unfortunately, the multiple sets of input switches make it confusing and difficult for an operator to control two or more output channels at the same time. Accordingly, it would also be desirable to provide a controller having a plurality of output channels which can be controlled from either a single set of input switches or from separate sets of input switches.

Further, it would also be desirable to provide a controller having a single design which overcomes each of the three identified shortcomings of the prior art.

SUMMARY OF THE INVENTION

The present invention provides a controller for a model toy train set. In a first aspect of the invention, a controller includes a plurality of input connectors for receiving supply power from at least one remote power supply and a plurality of output connectors for providing output power to a train set. A control circuit selectively controls power from the input connectors to the output connectors in response to a control signal.

In a second aspect of the invention, a controller includes an output connector for providing a variable amount of output power to a train set. A first input device produces a first input signal indicating a first amount of power. A second input device provides a second input signal indicating an operator selected power value. A processor receives the first and second input signals and calculates a second amount of power equal to or less than the first amount of power. A control circuit varies supply power from a power supply to provide the output connector with output power equal to the second amount of power.

In a third aspect of the invention, a controller includes a first and second output channel for producing output signals to operate a train set. A first and second set of inputs produce input signals. A processor receives input signals from the first and second sets of inputs and produces control signals to control the first and second output channels. A programming circuit has a first mode for controlling the first output channel in response to input signals from the first set of inputs and the second output channel in response to input signals from the second set of inputs and a second mode for controlling both the first and second output channels in response to input signals from one of either the first or second set of inputs.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 6A is an electrical schematic diagram of a first portion of a preferred embodiment of the model toy train set controller in accordance with the present invention showing a processor, the programming circuit, and four input connectors;

DESCRIPTION OF THE PREFERRED EMBODIMENT

Figure 1:
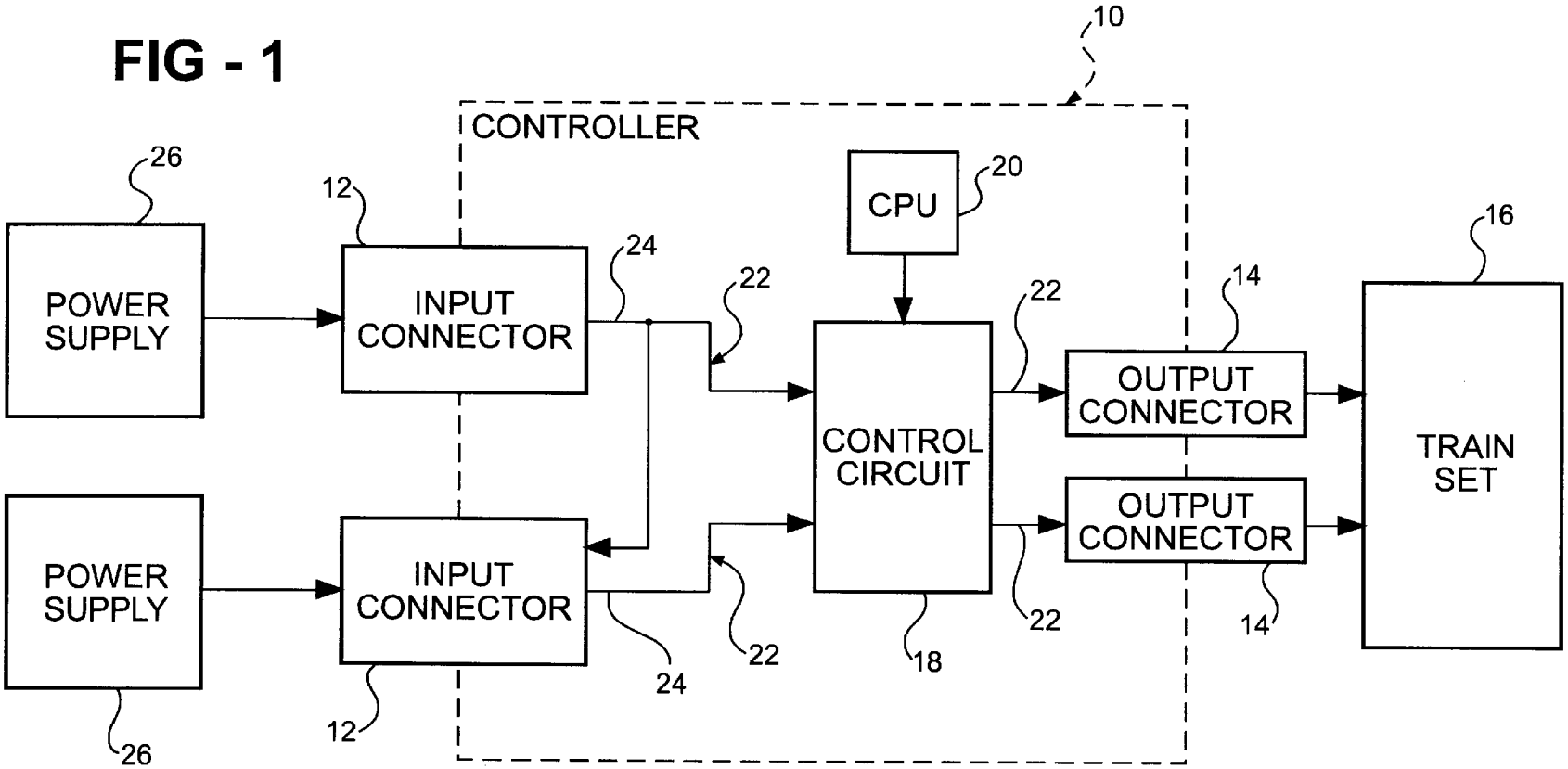
FIG. 1 is an electrical schematic block diagram of a portion of a model toy train set controller in accordance with a first aspect of the invention having a plurality of input connectors receiving power from a plurality of power supplies.

The present invention provides a controller for a model toy train set including one or more trains which travel around one or more train track loops. The controller includes a plurality of outputs for providing power to control the speed and direction of the toy trains. The speed of a toy train is controlled by varying the amount of power supplied to the train track loop. The direction of a toy train is reversed by a momentary interrupt of power to the train track loop. The controller is also designed to control other train accessories, such as a train horn and/or a train bell, associated with each output.

The description herein makes reference to several aspects of the present invention, wherein like reference numerals are increased by multiples of 100 to indicate like parts throughout the several aspects.

In a first aspect of the invention, a controller can receive supply power from one or more power supplies and provide such power to a plurality of output connectors. FIG. 1 is an electrical schematic block diagram of a portion of a model toy train set controller 10 in accordance with the first aspect of the invention.

The controller 10 includes a plurality of input connectors 12 for receiving supply power and a plurality of output connectors 14 for providing output power to a model toy train set 16. A control circuit 18 selectively controls or varies power from the input connectors 12 to the output connectors 14 in response to a control signal. In keeping with the invention, the controller 10 includes a processor or central processing unit (CPU) 20 for producing the control signal to operate the control circuit 18 in response to an input signal. The processor 20 preferably produces the control signal by executing a program stored in memory. Preferably, each input connector 12 and each output connector 14 consists of a plastic body portion disposed within the case of the controller 10 for housing one or more electrical terminals.

Each input connector 12 includes a power circuit 22 in electrical communication with a different output connector 14. In this manner, each input connector 12 has a power circuit 22 capable of receiving supply power at the input connector and transmitting such power through the control circuit 18 to a separate output connector 14.

Each power circuit 22 includes a terminal end 24 disposed in the respective input connector 12 to receive supply power directly from a separate power supply 26. Thus, in a power supply arrangement as shown in FIG. 1, each input connector 12 receives supply power directly from a separate power supply 26 and provides such power through the control circuit 18 to a separate output connector 14.

Figure 2:
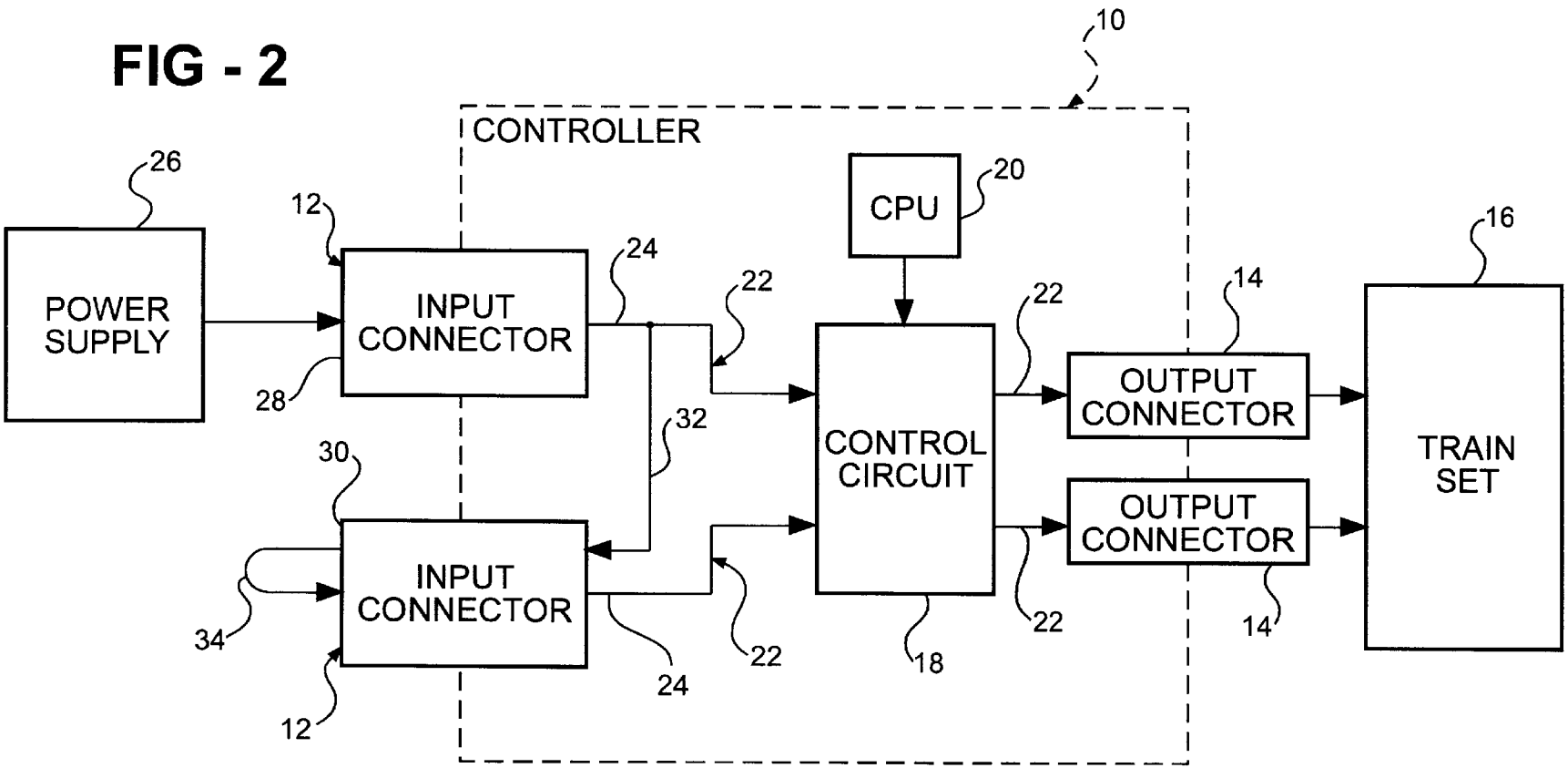
FIG. 2 is an electrical schematic block diagram of the model toy train set controller of FIG. 1 with the plurality of input connectors receiving power from one power supply.

FIG. 2 is an electrical schematic block diagram of the controller 10 of FIG. 1 showing an alternative power supply arrangement. In FIG. 2, the plurality of input connectors 12 receive power from only one power supply 26. In this power supply arrangement, the set of input connectors 12 includes one input connector 28 referred to as a primary input connector and at least one input connector 30 referred to as a secondary input connector. The secondary input connector 30 includes a jumper circuit 32 in electrical communication with the power circuit 22 of the primary input connector 28.

To supply power to the controller 10, the single power supply 26 is connected directly to the primary input connector 28 and a jumper wire 34 is connected between the jumper circuit 32 and the power circuit 22 of the secondary input connector 30. The jumper wire 34 is designed to supply or bridge power from the power circuit 22 of the primary input connector 28 to the power circuit 22 of the secondary input connector 30. Thus, in the power supply arrangement as shown in FIG. 2, the input connectors 12 receive supply power from the same power supply 26 and provide such power through the control circuit 18 to separate output connectors 14.

In the first aspect of the invention, as shown in FIGS. 1 and 2, the controller 10 can receive power from one or more power supplies 26 and provide such power to the plurality of output connectors 14. As a result of the first aspect of the invention, the controller 10 is capable of providing more power than prior art controllers to the train set 16 and the power supplies 26 may be placed at locations away from the controller 10, such as on a floor beneath the controller 10 and train set 16.

In a preferred embodiment of the first aspect of the invention, the controller includes four input connectors for receiving supply power from up to four power supplies. Receiving supply power from four power supplies makes the controller three times more powerful than conventional controllers. Preferably, each power supply is a 190-watt Lionel Powerhouse™ Power Supply or a 135-watt Lionel Powerhouse™ Power Supply for transforming one hundred ten volts a.c. to eighteen volts a.c. The control circuit receives the a.c. voltage waveform from one or more of the input connectors, adjusts the phase angle or the peak to peak voltage level of the a.c. voltage, and provides the adjusted a.c. voltage to the appropriate output connector.

Lionel 190-watt Powerhouse™ Power Supplies are available from Lionel L.L.C., located in Chesterfield, Mich. under the part number 6-22983. Lionel 135-watt Powerhouse™ Power Supplies are available from Lionel L. L. C., located in Chesterfield, Mich. under the part number 6-12866. A preferred processor is available from Microchip Technology, Inc., located in Chandler, Ariz. under the part number P1C16C65.

Figure 3:
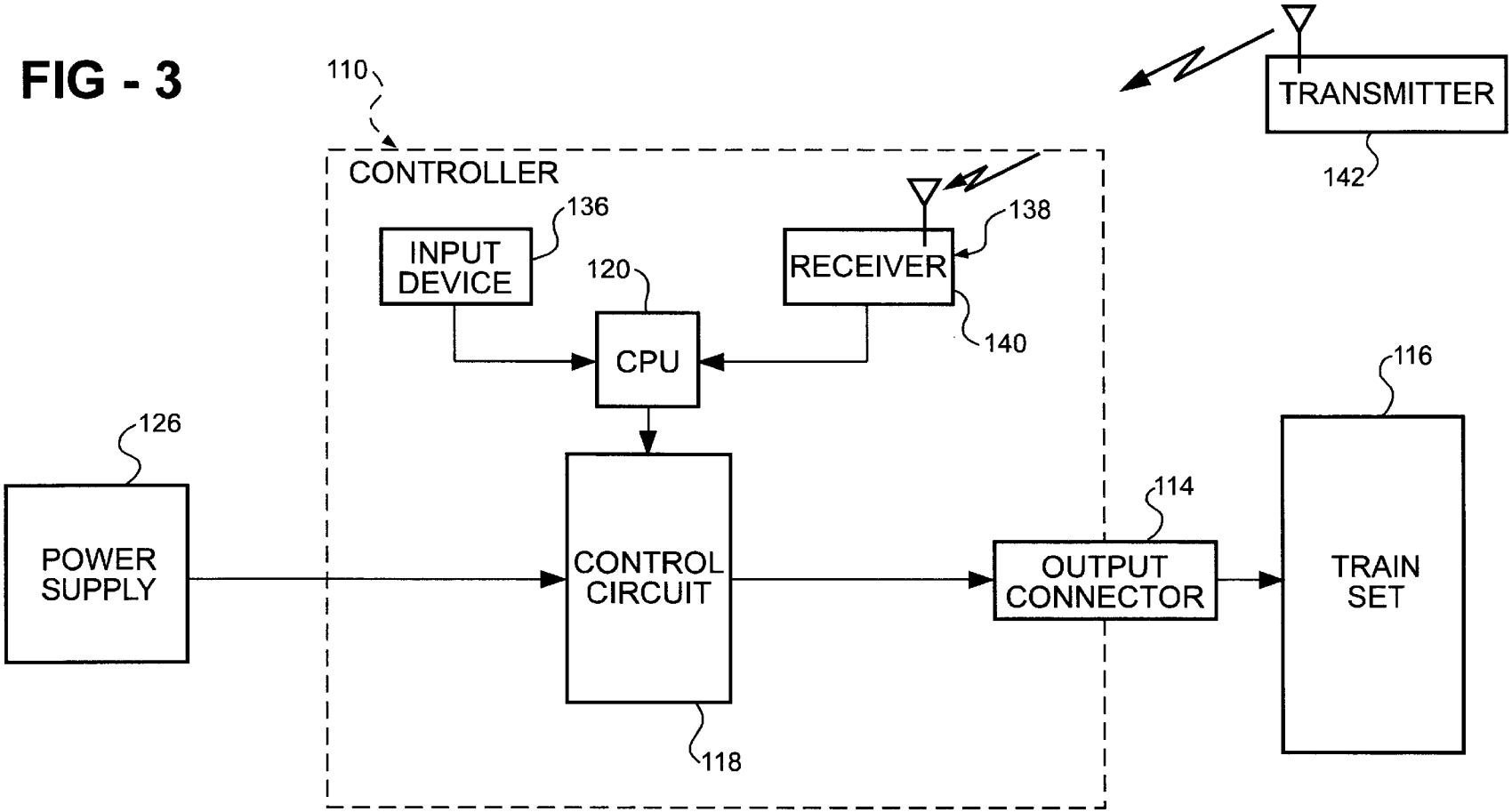
FIG. 3 is an electrical schematic block diagram of a portion of a model toy train set controller in accordance with a second aspect of the invention having an input device for producing an input signal to limit the amount of output power supplied from the controller to a toy train set.

In a second aspect of the invention, a controller can limit the amount of output power supplied to a toy train set when the controller is remotely operated from a transmitter. FIG. 3 is an electrical schematic block diagram of a portion of a model toy train set controller 110 in accordance with the second aspect of the invention.

The controller 110 includes an output connector 114 for providing a variable amount of output power to a train set 116. A first input device 136, such as a variable resistor, produces a first input signal indicating a first amount of power. A second input device 138, such as a receiver, provides a second input signal indicating an operator selected power value. A processor 120 receives the first and second input signals and calculates a second amount of power equal to or less than the first amount of power. A control circuit 118 receives supply power from a power supply 126 and varies the supply power to provide the output connector 114 with output power equal to the second amount of power. Thus, through the controller 110 an operator can selectively set the first input device 136 to limit the amount of output power supplied from the controller 110 to the toy train set 116.

To calculate the second amount of power, the processor 120 multiplies the first amount of power, typically a number representing a voltage level, by the operator selected power value, typically a number representing a percentage from 0% to 100%. The processor 120 then produces a control signal for operating the control circuit 118 to provide the output connector 114 with output power equal to the second amount of power. For example, if the first input device 136 produces a first input signal indicating a voltage level of 10 volts and the second input device 138 provides a second input signal indicating an operator selected power value of 50%, then the second amount of power will equal 5 volts.

The power supplied to the controller 110 from the power supply 126 is typically an a.c. voltage having a phase angle and a peak to peak voltage level. To control the speed of a locomotive in the train set 116, the controller 110 must provide a variable amount of output power to the train set 116. Accordingly, the control circuit 118 can vary the amount of output power provided to the output connector 114 in one of two ways. In a first way, the control circuit 118 shifts the phase angle of the a.c. voltage to vary the amount of output power provided to the output connector 114. In a second way, the control circuit 118 adjusts the peak to peak voltage level of the a.c. voltage to vary the amount of output power provided to the output connector 114.

Preferably, the speed of the locomotive can be directly or remotely controlled by the operator. In the remote control mode, the control circuit 118 provides the output connector 114 with output power equal to the second amount of power. In the direct control mode, the control circuit 118 provides the output connector 114 with output power equal to the first amount of power.

The first input device 136 is a variable resistor, such as a potentiometer, rheostat, or other similar type of electrical component. The second input device 138 is a receiver 140 disposed within the controller 110 for receiving a wireless signal (such as a radio frequency signal, an infrared signal, or other similar type of signal) from a portable, hand held transmitter 142 and producing the second input signal in response to the wireless signal, as shown in FIG. 3. Alternatively, the second input device 138 is an input port 141 for receiving the second input signal from a receiver 140 remotely controlled by an wireless signal from a remote transmitter 142, as shown in FIG. 4.

Thus, when the controller 110 is remotely operated from the transmitter 142, the first input device 136 can be selectively set by the operator to limit the amount of output power supplied from the controller 110 to the toy train set 116. In this manner, the first input device 136 can be manually set by the operator to limit the maximum speed of the locomotive when the operator is remotely controlling the speed of the locomotive from the transmitter 142.

Alternatively, when the controller 110 is directly operated, the first input device 136 can be selectively adjusted by the operator to vary the amount of output power supplied from the controller 110 to the toy train set 116. In this manner, the first input device 136 can be manually adjusted by the operator to directly and independently control the speed of the locomotive.

Figure 4:
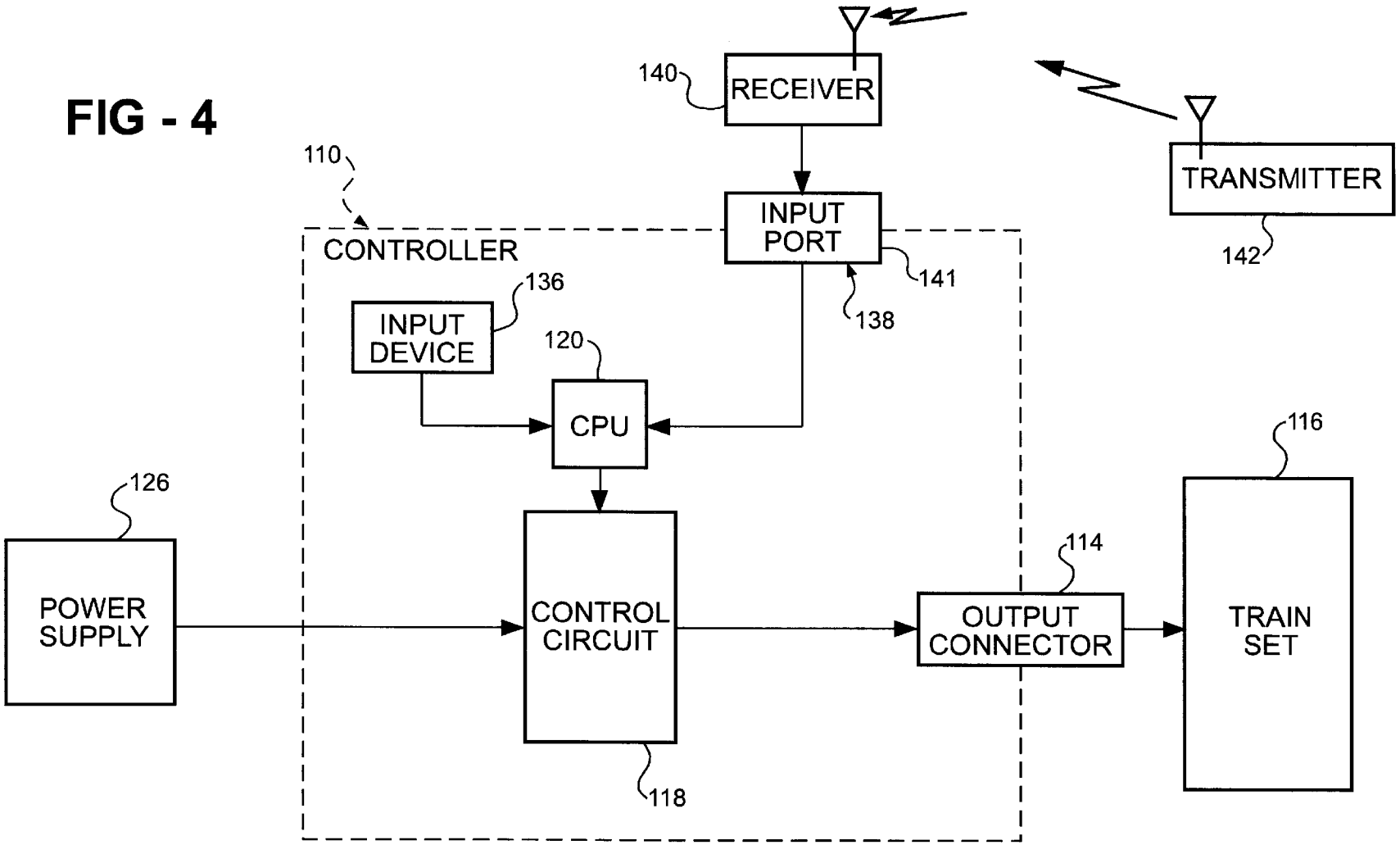
FIG. 4 is an electrical schematic block diagram of a portion of an alternative embodiment of a model toy train controller in accordance with the second aspect of the invention.

In the second aspect of the invention, as shown in FIGS. 3 and 4, the controller 110 can limit the amount of output power supplied to the toy train set 116 when the controller 110 is remotely operated from the transmitter 142. As a result of the second aspect of the invention, the operator can manually set the maximum locomotive speed when the speed of the locomotive is remotely controlled via the transmitter 142.

In a preferred embodiment of the second aspect of the invention, the first input device is a variable resistor disposed within the controller and having a control handle or dial which accessible to the operator, the second input device is a receiver disposed within the controller for receiving signals from a command base remote control transmitter, and the power supply is a 135-watt or 190-watt Lionel Powerhouse™ Power Supply. Accordingly, the operator can use a Lionel TCC CAB-1 remote control transmitter to remotely control the speed of the locomotive up to the pre-set level of the voltage handle or dial on the controller. This second aspect of the invention is particularly suited to help less-experienced operators keep the locomotive under control while operating the train set from the Lionel TCC CAB-1. The TCC CAB-1 is a portable, hand held remote control transmitter available from Lionel L. L. C., located in Chesterfield, Mich. under the part number 6-12868.

Figure 5:
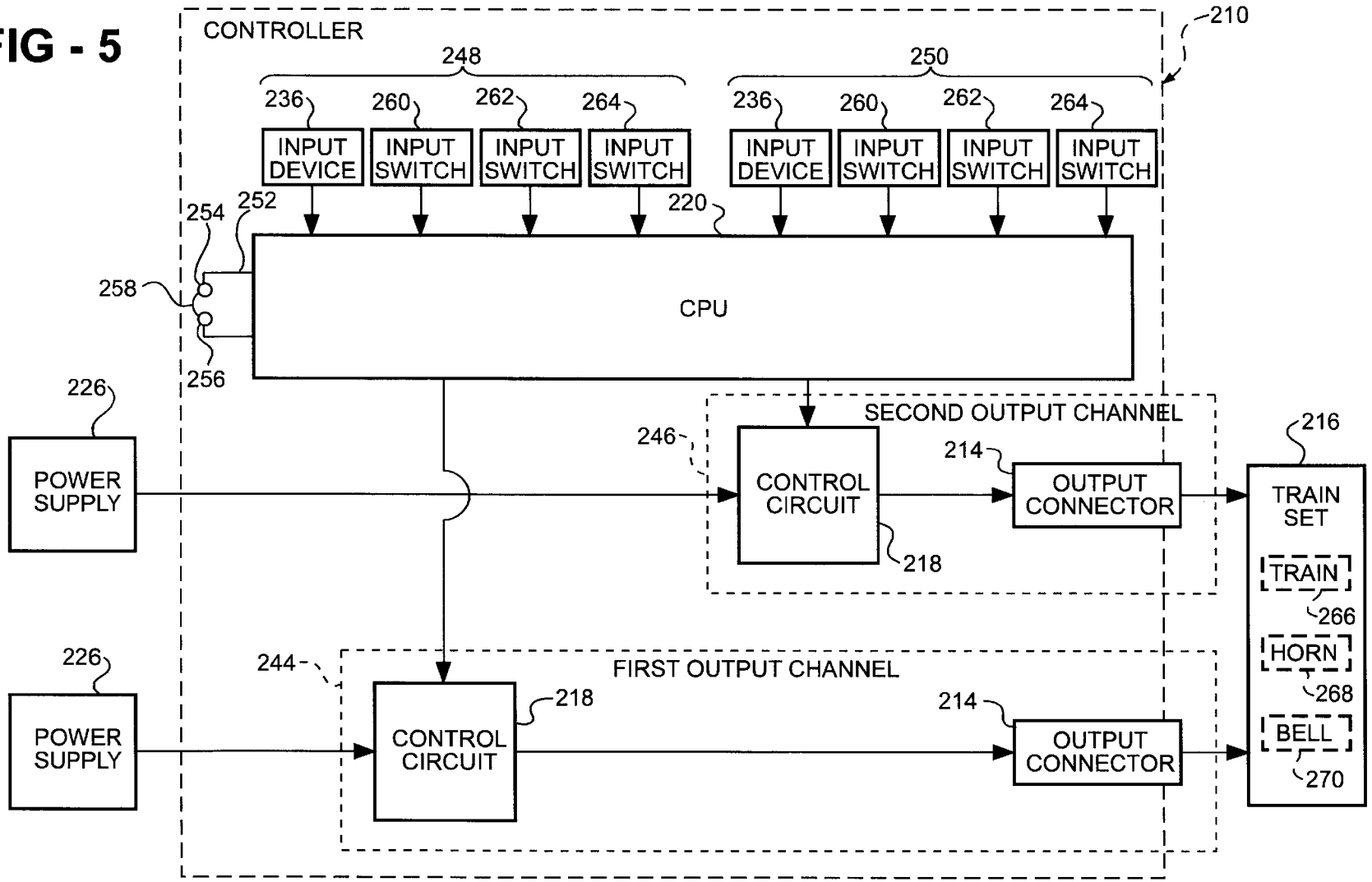
FIG. 5 is an electrical schematic block diagram of a portion of a model toy train set controller in accordance with a third aspect of the invention having a programming circuit for controlling a plurality of output channels from a single set of inputs or controlling each of the plurality of output channels from a separate set of inputs.

In a third aspect of the invention, a controller can control a plurality of output channels from a single set of inputs or control each of the plurality of output channels from a separate set of inputs. FIG. 5 is an electrical schematic block diagram of a portion of a model toy train set controller 210 in accordance with the third aspect of the invention.

The controller 210 includes a first and second output channel 244 and 246 for producing output signals to operate a train set 216. A first and second set of inputs 248 and 250 produce input signals. A processor 220 receives input signals from the first and second sets of inputs 248 and 250 and produces control signals to control the first and second output channels 244 and 246. A programming circuit 252 has a first mode for controlling the first output channel 244 in response to input signals from the first set of inputs 248 and the second output channel 246 in response to input signals from the second set of inputs 250 and a second mode for controlling the first and second output channels 244 and 246 in response to input signals from one of either the first or second set of inputs 248 or 250.

To program the controller 210, the programming circuit 252 includes a pair of terminals 254 and 256 normally open for placing the programming circuit 252 in either the first mode or the second mode and for receiving a shorting wire 258, as shown in FIG. 5, for placing the programming circuit 252 in the other mode.

Each output channel 244 and 246 includes a control circuit 218, for producing an output signal in response to a control signal from the processor 220, and an output connector 214, for providing the output signal to the train set 216. Each control circuit 218 receives an a.c. voltage, having a phase angle and a peak to peak voltage level, from a power supply 226.

Each set of inputs 248 and 250 includes an input device 236, a first input switch 260, a second input switch 262, and a third input switch 264. Each input device 236 produces an input signal indicating a selected train speed. In response to a selected train speed input signal, the appropriate control circuit 218 adjusts either the phase angle or peak to peak voltage level of the a.c. voltage to produce an output signal for controlling the speed of a train 266. Preferably, the input device 236 is a variable resistor, such as a potentiometer, rheostat, or other similar type of electrical component, having a handle or dial which is accessible to an operator.

Each first switch 260 produces an input signal indicating a reverse train direction request. In response to a reverse request input signal, the appropriate control circuit 218 momentarily interrupts the a.c. voltage to produce an output signal for reversing the direction of the train 266. Typically, the a.c. voltage is momentarily interrupted for one second.

Each second switch 262 produces an input signal indicating a horn request. In response to a horn request input signal, the appropriate control circuit 218 offsets the a.c. voltage with a first d.c. voltage to produce an output signal for controlling a horn 268. Typically, the first d.c. voltage offset is +3 volts.

Each third switch 264 produces an input signal indicating a bell request. In response to a bell request input signal, the appropriate control circuit 218 offsets the a.c. voltage with a second d.c. voltage to produce an output signal for controlling a train bell 270. Typically, the second d.c. voltage offset is −3 volts.

In the third aspect of the invention, as shown in FIG. 5, the controller 210 can control the plurality of output channels 244 and 246 from a single set of inputs 248 or 250 or from separate sets of inputs 248 and 250. As a result of the third aspect of the invention, the operator can more easily control a plurality of output channels at the same time.

In a preferred embodiment of the third aspect of the invention, the controller includes four output channels and four sets of inputs designated by letters A, B, C, and D. Each output channel A, B, C, and D produces output signals to operate either a separate train track loop or an electrically isolated section of a single train track loop.

In the preferred embodiment of the third aspect of the invention, the terminals of the programming circuit are left open for placing the controller in the first mode and are shorted with the shorting wire for placing the controller in the second mode.

In the first mode, output channel A is controlled in response to input signals from the set of A inputs, output channel B is controlled in response to input signals from the set of B inputs, output channel C is controlled in response to input signals from the set of C inputs, and output channel D is controlled in response to input signals from the set of D inputs. Thus, operating the controller in the first mode is particularly suited for controlling multiple train track loops wherein, for example, each output channel A, B, C, and D is connected to a separate first, second, third, and fourth train track loop respectively. In this arrangement, the set of A inputs controls the train speed, train direction, horn, and bell for the first train track loop, the set of B inputs controls the train speed, train direction, horn, and bell for the second train track loop, the set of C inputs controls the train speed, train direction, horn, and bell for the third train track loop, and the set of D inputs controls the train speed, train direction, horn, and bell for the fourth train track loop.

Nevertheless, the controller can also be operated in the first mode to control a single train track loop. For example, a single train track loop is divided into four electrically isolated sections with insulating pins. Insulating pins are available from Lionel L. L. C., located in Chesterfield, Mich. under the part number 6-65534. Output channels A, B, C, and D are connected to separate first, second, third, and fourth sections of the loop respectively. The insulating pins are adapted to electrically isolate each section of the loop from the other sections. In this arrangement, the set of A inputs controls the train speed, train direction, horn, and bell when the locomotive rides upon the first section of the loop, the set of B inputs controls the train speed, train direction, horn, and bell when the locomotive rides upon the second section of the loop, the set of C inputs controls the train speed, train direction, horn, and bell when the locomotive rides upon the third section of the loop, and the set of D inputs controls the train speed, train direction, horn, and bell when the locomotive rides upon the fourth section of the loop.

In the second mode, output channels A, B, C, and D are controlled in response to input signals from the set of A inputs. In other words, the bell switch, horn switch, and direction switch of the set of A inputs simultaneously activate all four output channels A, B, C, and D. Thus, operating the controller in the second mode is particularly suited for controlling a single large train track loop.

For example, a single large train track loop is divided into four electrically isolated sections with insulating pins. Output channel A is connected to an uphill section of the loop. Output channel B is connected to a downhill section of the loop. Output channels C and D are connected to separate flat sections of the loop. The insulating pins are adapted to electrically isolate each section of the loop from the other sections. Voltage handle A is set to the maximum voltage, typically 18 volts, and voltage handles B, C, and D are also set to the maximum position. Thus, in direct response to the setting of voltage handle A, maximum voltage is supplied to each section of the loop. If voltage handle A is set to a lower voltage, for example 14 volts, then 14 volts is supplied to each section of the loop.

However, in this arrangement, the downhill and flat loop sections B, C, and D require less voltage than the uphill loop section A. In the second mode, the output voltage of any output channel can be reduced relative to that of the master voltage handle (in this example, handle A) by adjusting the respective slave voltage handle (in this example, handles B, C, or D) to a desired lower voltage. Thus, voltage handle B is set to 14 volts, voltage handle C is set to 16 volts, and voltage handle D is set to 16 volts. In this manner, a train can be controlled about the entire large train track loop by the set of A inputs. Activation of the bell switch, horn switch, and reverse direction switch of the set of A inputs simultaneously controls all four output channels A, B, C, and D. In other words, bell switch A activates the bell regardless of which section of the loop the locomotive is riding on, horn switch A activates the horn regardless of which section of the loop the locomotive is riding on, and reverse direction switch A reverses the direction of the train regardless of which section of the loop the locomotive is riding on.

In accordance with the operation of the controller in the second mode, if a slave voltage handle (in this example, handles B, C, or D) is set to a position less than maximum, then the respective or similarly designated output channel will supply an output voltage which is proportionally reduced with respect to the master voltage handle setting. For example, if the slave voltage handle B is set to a half-maximum position (in this example, a 9 volt setting) and the master voltage handle is set to 10 volts, then output channel B will supply 5 volts to the train set.

FIG. 6A is an electrical schematic diagram of a first portion of a preferred embodiment of a model toy train set controller 310 in accordance with the first, second, and third aspects of the invention. In the preferred embodiment, the circuits of the controller 310 are disposed on a PCB (printed circuit board).

The controller 310 includes four input connectors 312*a–d* for receiving supply power from one or more power supplies and providing such power to four output channels 344*a–d* (shown in FIG. 6C) respectively. Preferably, the input connectors 312*a–d* are disposed within the case of the controller 310 to receive supply power from 135-watt or 190-watt Lionel Powerhouse™ Power Supplies. Four power circuits 322*a–d* pass supply power from the input connectors 312*a–d* to the output channels 344*a–d* respectively. In FIG. 6A, the four power circuits 322*a–d* illustratively pass supply power from the input connectors 312*a–d* to nodes VSA, VSB, VSC, and VSD respectively.

The set of input connectors 312*a–d* includes one primary input connector 312*a* and three secondary input connectors 312*b–d*. The primary input connector 312*a* must receive supply power from a power supply to energize the controller 310. Each secondary input connector 312*b–d* includes a jumper circuit 332*b–d* for jumping or bridging supply power from an adjacent power circuit 322*a–c* respectively. In this arrangement, each secondary input connector 312*b–d* can receive supply power directly from a power supply or, alternatively, jumper wires can be sequentially installed in the secondary connectors 312*b–d* between the jumper circuits 332*b–d* and the power circuits 322*b–d* respectively to jump or bridge power from an adjacent power circuit 322*a–c*. In other words, power can be bridged from power circuit 322*a* to power circuit 322*b* by installing a jumper wire between pins 1 and 2 of input connector 312*b*, from power circuit 322*b* to power circuit 322*c* by installing a jumper wire between pins 1 and 2 of input connector 312*c*, and from power circuit 322*c* to power circuit 322*d* by installing a jumper wire between pins 1 and 2 of input connector 312*d*.

The controller 310 also includes a processor 320, mounted to the PCB, for receiving input signals through switch connectors 372 and 374 from a plurality of input controls. Switch connectors 372 and 374 are connected to switch connectors 372' and 374' respectively, shown in FIG. 6B.

Figure 6B:
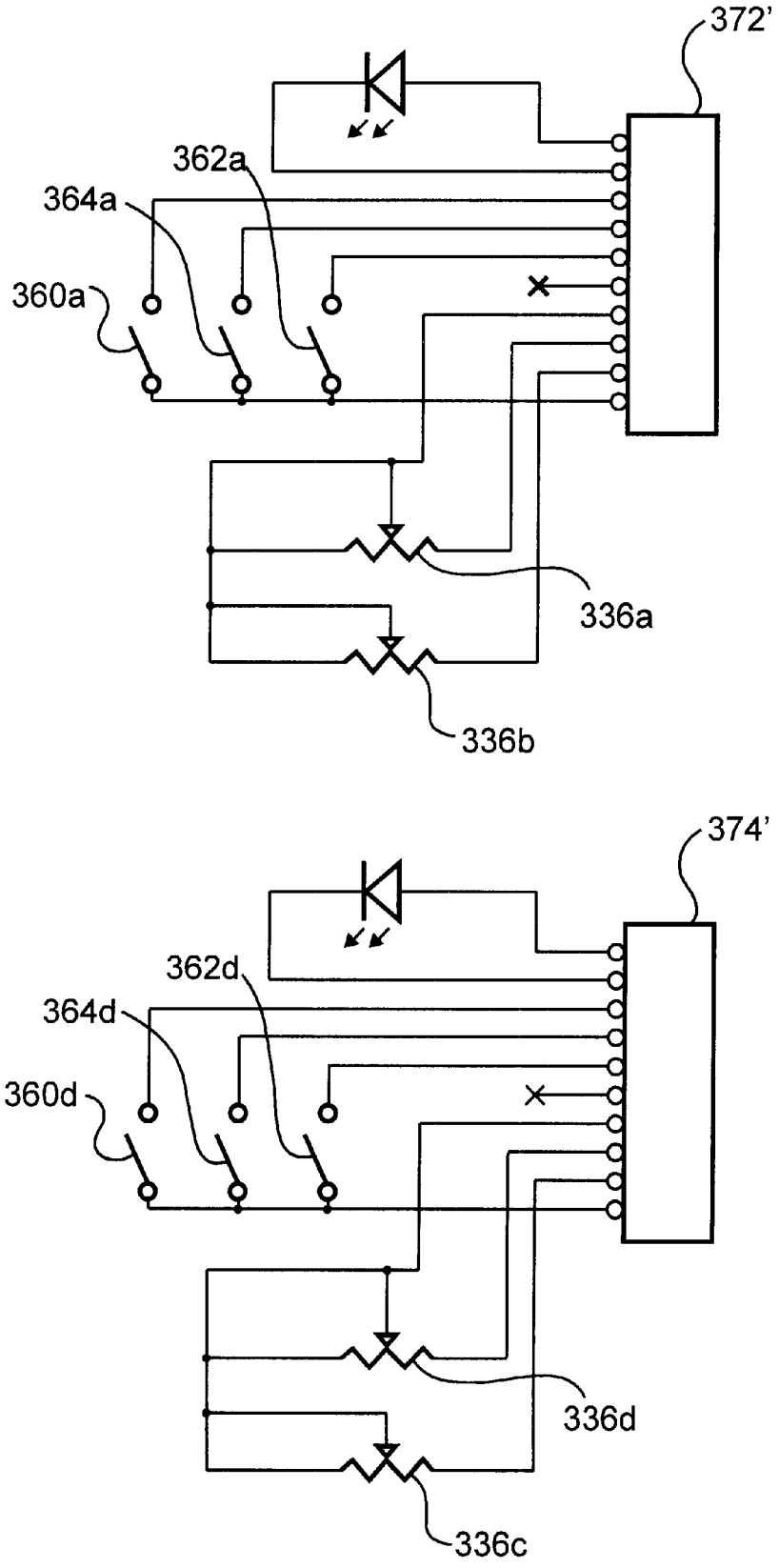
FIG. 6B is an electrical schematic diagram of a second portion of the preferred embodiment of the controller showing the controller inputs.

FIG. 6B is an electrical schematic diagram of a second portion of the preferred embodiment of the controller 310 showing the plurality of input controls. In the preferred embodiment, the plurality of input controls are disposed on the outer surface of the controller case and, therefore, are accessible to an operator. Each variable resistor 336*a–d* transmits an input signal indicating a selected train speed to the processor 320.

Referring to FIGS. 6A and 6B, variable resistor 336*a* transmits a selected train speed input signal through pin 8 of switch connectors 372 and 372' to pin 2 of the processor 320. Variable resistor 336*b* transmits a selected train speed input signal through pin 9 of switch connectors 372 and 372' to pin 3 of the processor 320. Variable resistor 336*c* transmits a selected train speed input signal through pin 9 of switch connectors 374 and 374' to pin 4 of the processor 320. Variable resistor 336*d* transmits a selected train speed input signal through pin 8 of switch connectors 374 and 374' to pin 5 of the processor 320.

Each input switch 362*a* and 362*d* transmits an input signal indicating a horn request to the processor 320. Input switch 362*a* transmits a horn request input signal through pin 5 of switch connectors 372 and 372' to pin 24 of the processor 320. Input switch 362*d* transmits a horn request input signal through pin 5 of switch connectors 374 and 374' to pin 26 of the processor 320.

Each input switch 364*a* and 364*d* transmits an input signal indicating a bell request to the processor 320. Input switch 364*a* transmits a bell request input signal through pin 4 of switch connectors 372 and 372' to pin 23 of the processor 320. Input switch 364*d* transmits a horn request input signal through pin 4 of switch connectors 374 and 374' to pin 25 of the processor 320.

Each input switch 360*a* and 360*d* transmits an input signal indicating a reverse train direction request to the processor 320. Input switch 360*a* transmits a reverse request input signal through pin 3 of switch connectors 372 and 372' to pins 23 and 24 of the processor 320. Thus, the processor 320 interprets simultaneous receipt of input signals from pins 23 and 24 as a request to reverse the direction of a train. Input switch 360*d* transmits a reverse request input signal through pin 3 of switch connectors 374 and 374' to pins 25 and 26 of the processor 320. Thus, the processor 320 interprets simultaneous receipt of input signals from pins 25 and 26 as a request to reverse the direction of a train.

A programming circuit 352 has a pair of terminals 354 and 356 normally open, as shown in FIG. 6A, to place the controller 310 in a first mode or shorted with a shorting wire to place the controller 310 in a second mode. In the first mode, output channels 344*a–d* are controlled in response to input signals from similarly designated variable resistors and input switches. In other words, output channel 344*a* is controlled in response to input signals from variable resistor 336*a* and input switches 360*a*, 362*a*, and 364*a*, output channel 344*b* is controlled in response to input signals from variable resistor 336*b*, output channel 344*c* is controlled in response to input signals from variable resistor 336*c*, and output channel 344*d* is controlled in response to input signals from variable resistor 336*d* and input switches 360*d*, 362*d*, and 364*d*.

In the second mode, output channels 344*a–d* are controlled in response to input signals from variable resistor 336*a* and input switches 360*a*, 362*a*, and 364*a*. In other words, variable resistor 336*a* controls the maximum train speed for all four output channels 344*a–d*, input switch 360*a* controls the train direction for all four output channels 344*a–d*, input switch 362*a* controls the train horn for all four output channels 344*a–d*, and input switch 364*a* controls the train bell for all four output channels 344*a–d*.

As previously described, train speed is a function of the amount of voltage supplied to a train. In the second mode, the amount of output voltage from output channels 344*b–d* can be reduced with respect to the amount of output voltage from output channel 344*a* in response to input signals from variable resistors 336*b–d* respectively. Input signals from variable resistors 336*b–d* control the amount of voltage from output channels 344*b–d* , respectively, between 100% of the voltage from output channel 344*a* when the respective variable resistor is set to its maximum position and 0% of the voltage from output channel 344*a* when the respective variable resistor is set to its minimum position. In other words, the amount of output voltage from output channel 344*b* can be reduced with respect to the amount of output voltage from output channel 344*a* by adjusting variable resistor 336*b* from its maximum setting to a lower setting, the amount of output voltage from output channel 344*c* can be reduced with respect to the amount of output voltage from output channel 344*a* by adjusting variable resistor 336*c* from its maximum setting to a lower setting, and the amount of output voltage from output channel 344*d* can be reduced with respect to the amount of output voltage from output channel 344*a* by adjusting variable resistor 336*d* from its maximum setting to a lower setting.

Figure 6C:
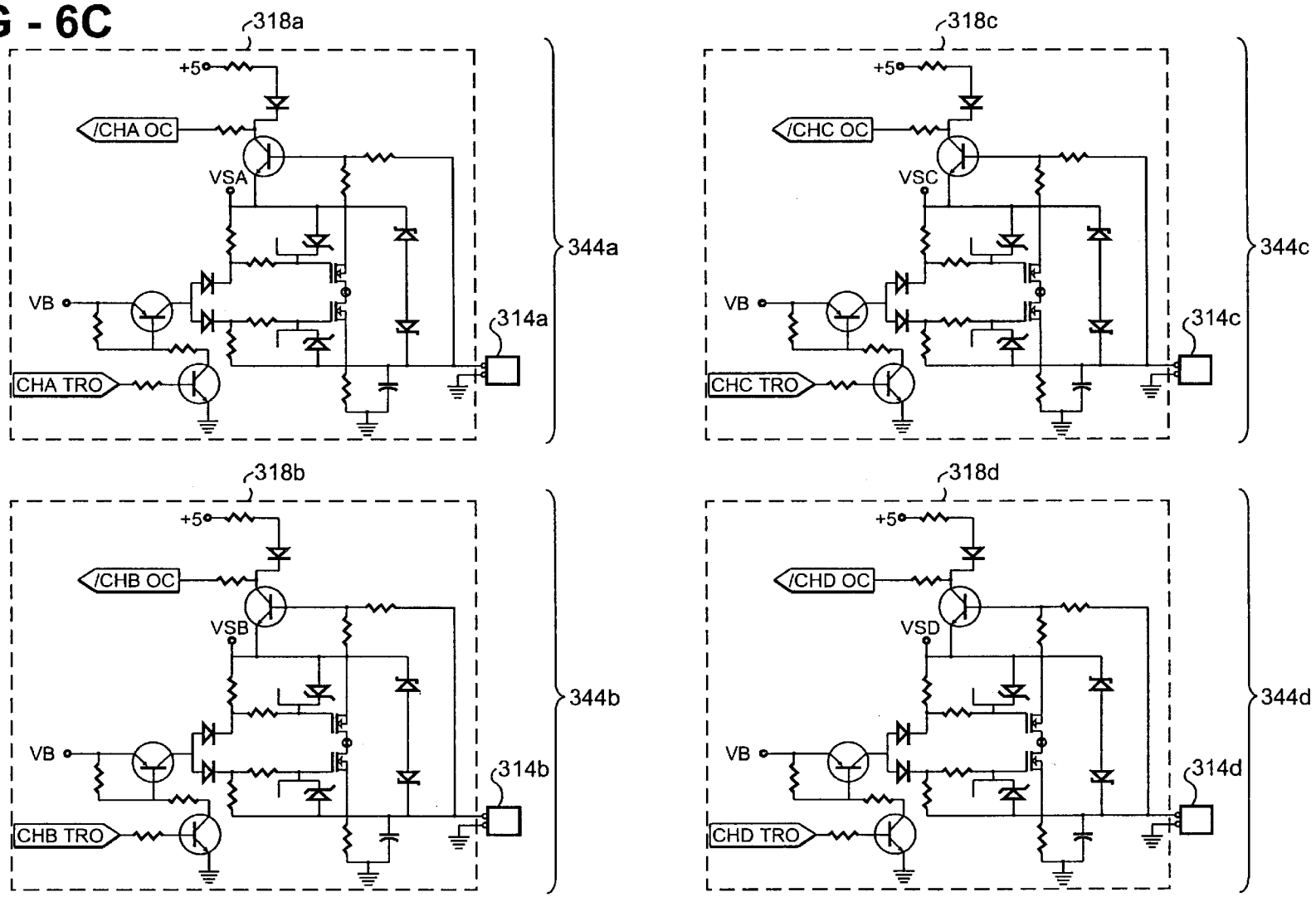
FIG. 6C is an electrical schematic diagram of a third portion of the preferred embodiment of the controller showing four output channels.

FIG. 6C is an electrical schematic diagram of a third portion of the preferred embodiment of the controller 310 showing the four output channels 344*a–d*. Output channel 344*a* includes a control circuit 318*a* and a output connector 314*a*. Control circuit 318*a* receives supply power from the power circuit 322*a* of input connector 312*a*, illustrated in FIG. 6A, through the VSA node illustrated in both FIGS. 6A and 6C. Control circuit 318*a* also receives a control or trigger signal from pin 33 of the processor 320, illustrated in FIG. 6A, through the CHA TRG node illustrated in both FIGS. 6A and 6C. The control signal operates the control circuit 318*a* to vary the supply power VSA thereby producing an output signal to operate a train set. Preferably, output connector 314*a* is disposed within the case of the controller 310 to provide the output signal to the train set.

Output channel 344*b* includes a control circuit 318*b* and a output connector 314*b*. Control circuit 318*b* receives supply power from the power circuit 322*b* of input connector 312*b*, illustrated in FIG. 6A, through the VSB node illustrated in both FIGS. 6A and 6C. Control circuit 318*b* also receives a control or trigger signal from pin 34 of the processor 320, illustrated in FIG. 6A, through the CHB TRG node illustrated in both FIGS. 6A and 6C. The control signal operates the control circuit 318*b* to vary the supply power VSB thereby producing an output signal to operate a train set. Preferably, output connector 314*b* is disposed within the case of the controller 310 to provide the output signal to the train set.

Output channel 344*c* includes a control circuit 318*c* and a output connector 314*c*. Control circuit 318*c* receives supply power from the power circuit 322*c* of input connector 312*c*, illustrated in FIG. 6A, through the VSC node illustrated in both FIGS. 6A and 6C. Control circuit 318*c* also receives a control or trigger signal from pin 35 of the processor 320, illustrated in FIG. 6A, through the CHC TRG node illustrated in both FIGS. 6A and 6C. The control signal operates the control circuit 318*c* to vary the supply power VSC thereby producing an output signal to operate a train set. Preferably, output connector 314*c* is disposed within the case of the controller 310 to provide the output signal to the train set.

Output channel 344*d* includes a control circuit 318*d* and a output connector 314*d*. Control circuit 318*d* receives supply power from the power circuit 322*d* of input connector 312*d*, illustrated in FIG. 6A, through the VSD node illustrated in both FIGS. 6A and 6C. Control circuit 318*d* also receives a control or trigger signal from pin 36 of the processor 320, illustrated in FIG. 6A, through the CHD TRG node illustrated in both FIGS. 6A and 6C. The control signal operates the control circuit 318*d* to vary the supply power VSD thereby producing an output signal to operate a train set. Preferably, output connector 314*d* is disposed within the housing of the controller 310 to provide the output signal to the train set.

Figure 6D:
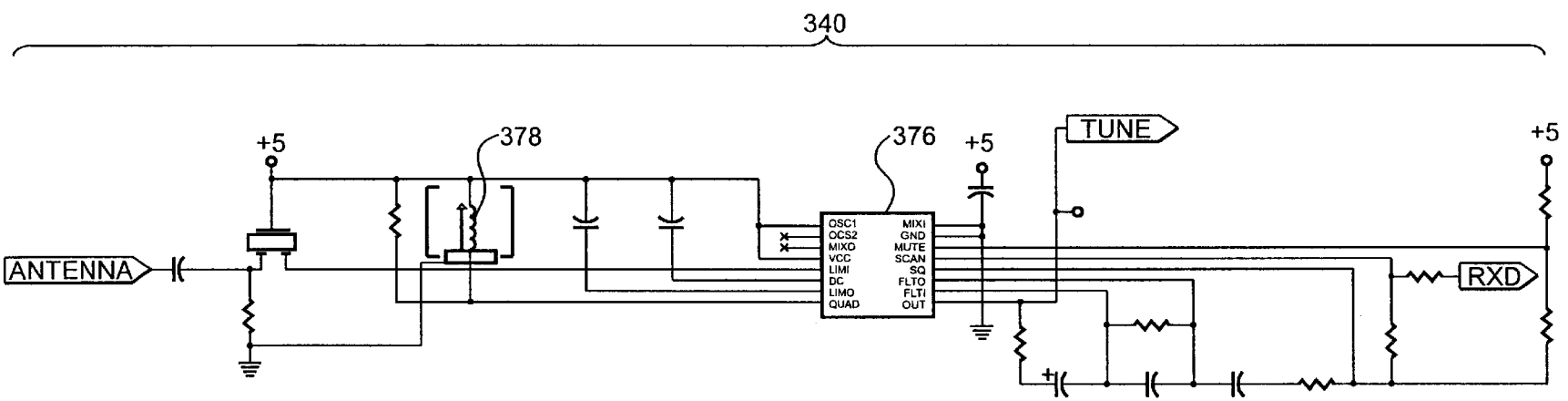
FIG. 6D is an electrical schematic diagram of a fourth and final portion of the preferred embodiment of the controller showing a receiver circuit.

FIG. 6D is an electrical schematic diagram of a fourth and final portion of the preferred embodiment of the controller 310 showing a receiver circuit 340. The receiver circuit 340 includes an integrated receiver chip 376 and a tuning coil 378. The ANTENNA and RXD nodes of FIG. 6C are in electrical communication with the ANTENNA and RXD nodes of FIG. 6A respectively. Referring to FIGS. 6A and 6D, the receiver chip 376 receives a radio frequency signal through pin 1 of an antenna connector 380 from an antenna, decodes the radio frequency signal, produces an input signal in response to the radio frequency signal, and transmits the input signal to pin 7 of the processor 320. In this manner, the processor 320 can receive input signals from a remote transmitter. Preferably, antenna connector 380 is a two pin leoco plug connector mounted to the PCB. The integrated receiver chip 376 is available from Motorola, located in Denver, Colo. under the part number MC3361BD.

In accordance with the scope of the present invention, the first, second, and third aspects can be incorporated within a single controller in any combination.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A controller for a model toy train set, the controller comprising:

an output connector for providing a variable amount of output power to the train set;

a first input device for producing a first input signal indicating a first amount of power;

a second input device for providing a second input signal indicating an operator selected power value;

a processor for receiving said first and second input signals and calculating a second amount of power equal to or less than said first amount of power; and a control circuit for varying supply power from a power supply to provide said output connector with output power equal to said second amount of power.

2. A controller as set forth in claim 1, wherein said processor calculates said second amount of power by multiplying said first amount of power by said operator selected power value.

3. A controller as set forth in claim 1, wherein the supply power is an a.c. voltage having a phase angle and said control circuit shifts the phase angle of the a.c. voltage to vary the output power provided to said output connector.

4. A controller as set forth in claim 1, wherein said the supply power is an a.c. voltage having a peak to peak voltage level and said control circuit adjusts the peak to peak voltage level of the a.c. voltage to vary the output power provided to said output connector.

5. A controller as set forth in claim 1, wherein said processor produces a control signal for operating said control circuit to provide said output connector with output power equal to said second amount of power.

6. A controller as set forth in claim 1, wherein the controller is operated in one of a remote control mode for providing said output connector with output power equal to said second amount of power and a direct control mode for providing said output connector with output power equal to said first amount of power.

7. A controller as set forth in claim 1, wherein said first input device is a variable resistor.

8. A controller as set forth in claim 1, wherein said second input device is a receiver for receiving a wireless signal from a remote transmitter and producing said second input signal in response to said wireless signal.

9. A controller as set forth in claim 1, wherein said second input device is an input port for receiving said second input signal from a receiver remotely controlled by a wireless signal from a portable transmitter.

10. A controller for a model toy train set controlled remotely by a transmitter, the controller comprising:

an output for providing output power to the train set;

a control circuit for receiving input power from a power supply, varying the input power in response to a wireless signal from the transmitter, and supplying the varied power to said output; and an input for limiting the supply of varied power to said output to a maximum amount.

11. A controller for a model toy train set, the controller comprising:

a first and second output channel for producing output signals to operate the train set;

a first and second input for producing input signals;

a processor for receiving input signals from said first and second inputs and producing control signals to control said first and second output channels; and a programming circuit having a first mode for controlling said first output channel in response to input signals from said first input and said second output channel in response to input signals from said second input and a second mode for controlling said first and second output channels in response to input signals from one of said first and second inputs.

12. A controller as set forth in claim 11, wherein said first input is one of a first set of inputs and said second input is one of a second set of inputs.

13. A controller as set forth in claim 11, wherein said programming circuit includes a pair of terminals normally open for placing said programming circuit in one of said modes and for receiving a shorting wire for placing said programming circuit in the other of said modes.

14. A controller as set forth in claim 11, wherein each output channel includes a control circuit for producing an output signal in response to at least one control signal from said processor and an output connector for providing the output signal to the train set.

15. A controller as set forth in claim 14, wherein said control circuit receives an a.c. voltage having a phase angle and a peak to peak voltage level from a power supply.

16. A controller as set forth in claim 15, wherein the train set includes a train and wherein each input includes an input device for producing an input signal indicating a selected train speed and said control circuit adjusts one of the phase angle and peak to peak voltage level of the a.c. voltage in response to the selected train speed input signal to produce an output signal for controlling train speed.

17. A controller as set forth in claim 16, wherein said programming circuit is placed in said second mode controlling said first and second output channels to produce equal first and second train speed output signals respectively in response to a selected train speed input signal from said first input device.

18. A controller as set forth in claim 17, wherein a selected train speed input signal from said second input device reduces the second train speed output signal relative to the first train speed output signal.

19. A controller as set forth in claim 18, wherein the reduction of the second train speed output signal is achieved by one of shifting the phase angle and reducing the peak to peak voltage level of the a.c. voltage.

20. A controller as set forth in claim 15, wherein the train set includes a train and wherein each input includes a first switch for producing an input signal indicating a reverse train direction request and said control circuit momentarily interrupts the a.c. voltage in response to the reverse request input signal to produce an output signal for reversing train direction.

21. A controller as set forth in claim 15, wherein the train set includes a horn and wherein each input includes a second switch for producing an input signal indicating a horn request and said control circuit offsets the a.c. voltage with a first d.c. voltage in response to the horn request input signal to produce an output signal for controlling the horn.

22. A controller as set forth in claim 15, wherein the train set includes a train bell and wherein each input includes a third switch for producing an input signal indicating a bell request and said control circuit offsets the a.c. voltage with a second d.c. voltage in response to the bell request input signal to produce an output signal for controlling the train bell.

23. A controller for a model toy train and model toy train track, the controller comprising:

a plurality of inputs adapted to receive power from more than one power supply;

a control circuit adapted to receive power from the plurality of inputs;

a plurality of outputs operatively connected to the control circuit and configured to be connected to the model toy train track such that power would be delivered to the track, and;

the control circuit operative to control the amount of power delivered to the model toy train track in response to a control signal.

24. A controller as in claim 23 wherein four power supplies are connected to the distinct inputs.

25. A controller as in claim 23 wherein at least one jumper connects at least two of the inputs.

26. A controller as in claim 23 further comprising a processor for producing the control signal.

27. A controller as in claim 26 further comprising a first input device for producing a first signal indicating a first amount of power;

a second input device for producing a second signal indicating an operator selected power value;

said processor operative to receive said first and second signals and operative to calculate a second amount of power equal to or less than said first amount of power, said control circuit operative in limiting the power supply to the outputs to the second amount of power.

28. A controller for a model toy train and model toy train track comprising:

a plurality of input connectors, each adapted to receive power from a power supply;

a control circuit receiving input power from the plurality of input connectors; and at least one output connector operatively connected to the control circuit and adapted to deliver output power to the model toy train track, wherein the control circuit controls the output power delivered to the model toy train track in response to a control signal and the input power.

29. A controller as in claim 23, further comprising four power supplies, each connected to one of the plurality of inputs.

* * * * *